US009318294B2

(12) United States Patent
Karlsson et al.

(10) Patent No.: US 9,318,294 B2
(45) Date of Patent: Apr. 19, 2016

(54) DEVICE FOR RAPID SHORT-CIRCUITING AND EARTHING OF THE PHASES IN A POWER NETWORK

(71) Applicants: Jan Karlsson, Ludvika (SE); Samuel Dahl, Vasa (FI)

(72) Inventors: Jan Karlsson, Ludvika (SE); Samuel Dahl, Vasa (FI)

( * ) Notice: Subject to any disclaimer, the term of this patent is extended or adjusted under 35 U.S.C. 154(b) by 0 days.

(21) Appl. No.: 14/435,304

(22) PCT Filed: Oct. 4, 2013

(86) PCT No.: PCT/SE2013/051169
§ 371 (c)(1),
(2) Date: Apr. 13, 2015

(87) PCT Pub. No.: WO2014/062114
PCT Pub. Date: Apr. 24, 2014

(65) Prior Publication Data

US 2015/0270084 A1 Sep. 24, 2015

(30) Foreign Application Priority Data

Oct. 19, 2012 (SE) ..... 1251191

(51) Int. Cl.
*H01H 79/00* (2006.01)
*H01H 3/22* (2006.01)
(Continued)

(52) U.S. Cl.
CPC ..... *H01H 79/00* (2013.01); *H01H 1/06* (2013.01); *H01H 1/14* (2013.01); *H01H 3/222* (2013.01)

(58) Field of Classification Search
CPC ..... H01H 79/00; H01H 1/14; H01H 1/06; H01H 3/222
See application file for complete search history.

(56) References Cited

U.S. PATENT DOCUMENTS 2,930,870 A 3/1960 Baer
3,246,101 A * 4/1966 Caputo ..... H01H 3/60 200/16 B (Continued)

FOREIGN PATENT DOCUMENTS

DE EP 0450104 A1 * 10/1991 ..... H01H 1/365
DE WO 0022641 A1 * 4/2000 ..... H01H 9/40

(Continued)

OTHER PUBLICATIONS

International Search Report dated Jan. 22, 2014, for International Patent Application No. PCT/SE2013/051169.

(Continued)

*Primary Examiner* — Mohamad Musleh
(74) *Attorney, Agent, or Firm* — Thomas & Karceski, PC

(57) ABSTRACT

The invention relates to a switching device for short-circuiting and earthing at least two phases in an electric power network. The device comprises a first phase contact, a second phase contact, and an earthed, movable contact, which can, on the one hand, assume a first position, where the contact is insulated from the phases, and, on the other hand, a second position, where the contact is connected to the phase contacts and thereby earths and short-circuits the phases. The device is characterized in that the first phase contact and the second phase contact are axially displaced from each other and that they are disposed around the movable contact, and that the contact is cylinder-shaped and comprises two circumferentially disposed contact areas, which are axially displaced from each other and intended to connect to the phase contacts in the second position, so that the phases are short-circuited and earthed via the contact, and that the device comprises electrically insulating areas, which are adapted to abut against the phase contacts in the first position.

8 Claims, 4 Drawing Sheets

(51) Int. Cl.
*H01H 1/06* (2006.01)
*H01H 1/14* (2006.01)

(56) References Cited

U.S. PATENT DOCUMENTS 8,791,779 B2 * 7/2014 Jonsson ..... H01H 3/222
200/239
8,797,128 B2 * 8/2014 Liljestrand ..... H01H 33/14
200/239
2004/0245857 A1 * 12/2004 Liljestrand ..... H01H 9/40
307/143
2011/0281475 A1 * 11/2011 Zhang ..... H01H 1/06
439/816

FOREIGN PATENT DOCUMENTS

| | | | |
|---|---|---|---|
| EP | 2073235 | A1 | 6/2009 |
| GB | 958743 | | 5/1964 |
| SE | 1001168 | A1 | 6/2012 |
| WO | WO 9619816 | | 6/1996 |

OTHER PUBLICATIONS

Written Opinion dated Jan. 22, 2014, for International Patent Application No. PCT/SE2013/051169.

* cited by examiner

DEVICE FOR RAPID SHORT-CIRCUITING AND EARTHING OF THE PHASES IN A POWER NETWORK

CROSS-REFERENCE TO RELATED APPLICATION(S)

This is a National Stage Entry into the United States Patent and Trademark Office from International PCT Patent Application No. PCT/SE2013/051169, having an international filing date of Oct. 4, 2013, which claims priority to Swedish Patent Application No. SE 1251191-1, filed Oct. 19, 2012, the entire contents of both of which are incorporated herein by reference.

FIELD OF THE INVENTION

The present invention relates to a switching device for short-circuiting and earthing at least two phases in an electric power network, which device comprises:

- a first phase contact, which is connected to a first phase in the electric power network;
- a second phase contact, which is connected to a second phase in the electric power network; and
- an earthed, movable contact, which can, on the one hand, assume a first position, where the movable contact is insulated from the phases, and, on the other hand, a second position, where the contact is connected to the phase contacts and thereby earths and short-circuits the phases with each other.

DESCRIPTION OF THE RELATED ART

Arc faults induced by a powerful electric network with high short-circuiting currents result in severe operational disturbances and cause a highly dangerous environment for persons in the vicinity thereof. The high temperature of the arcs produces a high pressure and gases from molten metal which are highly dangerous to inhale. In order to increase the personal security, the switchgears are therefore provided with flues to the outside air and the cabinets are dimensioned to resist a high internal pressure. In case of a fault, entire cabinets have to be replaced, and therefore the outage time will usually be several weeks. The cost for cabinets and pressure relief systems, as well as repair and outage costs, become very high, and in Sweden power suppliers have to pay compensation to their subscribers after 24 hours of interruption in the power supply. The need for devices which rapidly put out arcs is large both for low voltage (up to 1 kV) and medium voltage (1-52 kV). 5-10 arc faults occur every day in electric plants in the USA.

Many persons are killed or seriously injured and the cost of each fault is about 1.5 million USD. By means of rapidly short-circuiting the supplying network, the pressure increase can be strongly reduced and toxic gases will not have enough time to form. Thereby, the personal security is increased and the operational disturbance caused by an arc fault is limited to the time for checking the reason of the fault. The material damages will then become negligible. However, this requires that the short-circuiting is accomplished in about 5 ms.

A common method when short-circuiting the network is that the phases are short-circuited sequentially, i.e. one phase at a time. However, U.S. Pat. No. 2,930,870 discloses a variant wherein a contact closes all phases instantaneously in that the phases are disposed in a circumferential plane around an earthed contact, which can be moved up and down in order to short-circuit the phases. However, the contact device disclosed in U.S. Pat. No. 2,930,870 is complicated in its design and rather unwieldy.

SUMMARY OF THE INVENTION

The present invention intends to achieve a device which rapidly short-circuits the phases, and which is simple in its design with few constituent parts, and which is not associated with the disadvantages found with the device in U.S. Pat. No. 2,930,870.

The device according to the invention is characterized in that the first phase contact and the second phase contact are axially displaced from each other and that they are disposed around the movable contact, and that the movable contact is cylinder-shaped and comprises two circumferentially disposed contact areas, which contact areas are axially displaced from each other, and that the two contact areas are intended to connect to the two phase contacts in the second position, so that the phases are short-circuited and earthed via the movable contact, and that the device comprises electrically insulating areas, which are adapted to abut against the phase contacts in the first position.

BRIEF DESCRIPTION OF THE DRAWINGS

In the following, the invention will be described more closely with reference to attached drawings.

DETAILED DESCRIPTION OF THE EMBODIMENT(S) OF THE INVENTION

Figure 1:
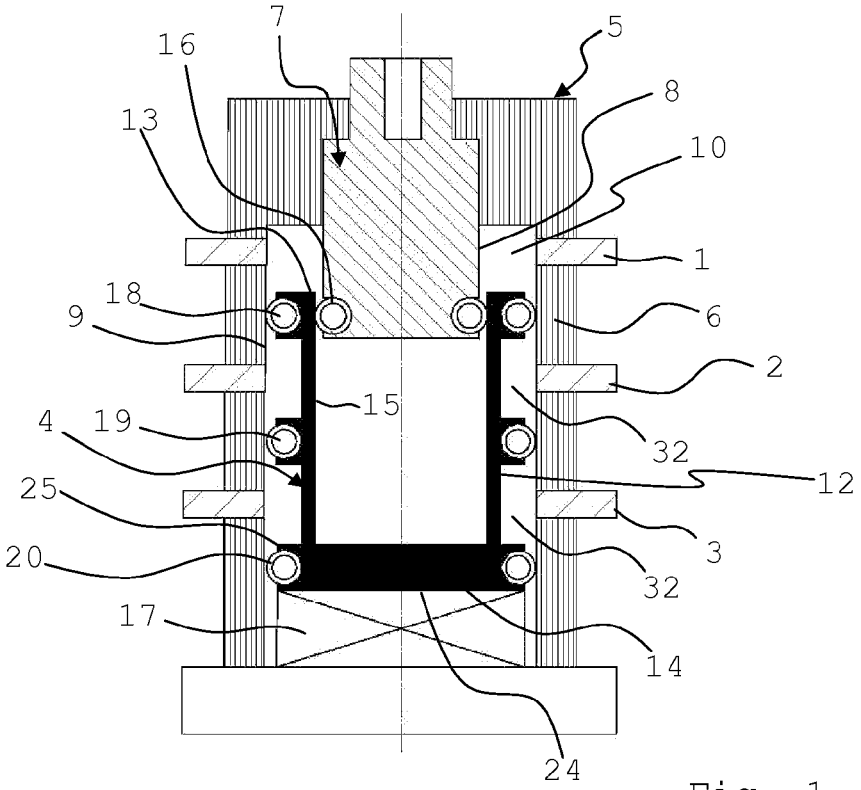
FIG. 1 shows an embodiment of the device according to the invention in cross-section, which device comprises a housing, phase contacts, an earthed, stationary contact, a movable contact, and a Thomson coil.

The device according to the invention comprises an electrically insulating, cylinder-shaped housing 5 with walls 6 in the shape of a cylinder. A first phase contact 1, a second phase contact 2 and a third phase contact 3 are disposed in the walls 6 of the housing 5. On the outside of the housing 5, each phase contact 1, 2, 3 is connected to a respective phase in the electric power network in which the device is operating. The phase contacts 1, 2, 3 are axially displaced from each other, so that the necessary electrical insulation is obtained between the phases. The housing 5 is suitably made of an electrically insulating polymer material.

Figure 2:
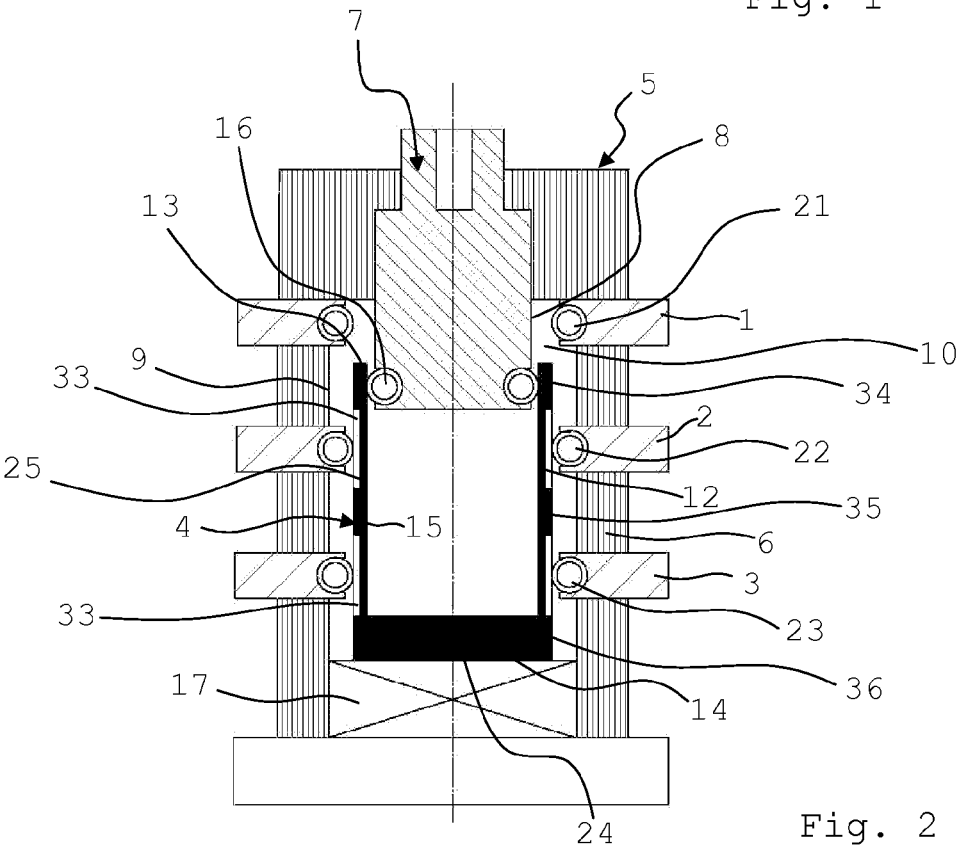
FIG. 2 shows an alternative embodiment of the device in FIG. 1.

Furthermore, the device comprises an upper, cylinder-shaped, earthed, stationary contact 7, which is shown in FIGS. 1 and 2. The earthed, stationary contact 7 is disposed in the upper portion of the housing 5, in the centre of the housing 5, and protrudes out from the housing 5 on the outside thereof. A circumferential contact element 16 is disposed close to the lower edge of the stationary contact 7. A cavity 10 is formed between the envelope surface 8 of the stationary contact and the interior envelope surface 9 of the housing.

The device also comprises a lower, cylinder-shaped, axially movable contact 4 with walls 12 in the shape of a cylinder. The movable contact 4 is open at its upper, first end 13, and has a closed bottom portion 24 at its lower, second end 14. The open end portion at the first end 13 of the movable contact surrounds the stationary contact 7 such that the contact element 16 of the stationary contact 7 is in electrical contact with the interior envelope surface 15 of the movable contact 4. Accordingly, at the first end 13, the walls 12 of the movable contact 4 are located in the cavity 10. The movable contact 4 can, on the one hand, assume a first position, where the movable contact is insulated from the phase contacts 1, 2, 3, and, on the other hand, a second position, where the movable contact 4 is connected to the three phase contacts and thereby short-circuits and earths the three phase contacts. The movable contact 4 is earthed by the stationary contact 7 during the entire movement of the movable contact 4 from the open, first position to the connected, second position.

The electrical connection between the movable contact 4 and the phase contacts 1-3 is achieved via three contact elements 18-20, 21-23. A first preferred embodiment, where the three contact elements 18-20 are disposed circumferentially around the walls 12 on the exterior envelope surface 25 of the movable contact 4, is shown in FIG. 1. The three contact elements 18-20 are axially displaced from each other along the movable contact 4 and their mutual distances are the same distances as the distances between the three phase contacts 1-3. The contact elements 18-20 are adapted to connect to a respective phase contact 1-3 in the connected, second position. In the open, first position, the contact elements 18-20 are located in a position below their respective phase contacts 1-3 and are thereby electrically insulated from the phase contacts 1-3. An insulating air gap 32 is formed between the contact elements 18-20, in that the movable contact 4 has a diameter in this region which is smaller than the external diameter at the contact elements 18-20. In the open, first position, the uppermost contact element 18 is insulated in that the upper, first end 13 of the movable cylinder is located below the first phase contact 1. The two other contact elements 19-20 are insulated in that the air gap 32 is at the positions of the two phase contacts 2, 3.

An alternative embodiment of the device, where the contact elements 21-23 between the movable contact 4 and the phase contacts 1-3 are disposed on the phase contacts 1-3 at the interior envelope surface 9 of the walls 6, is shown in FIG. 2. Here, the movable contact 4 is designed with three contact surfaces 34-36 disposed circumferentially on the envelope surface 25 of the movable contact. The contact surfaces 34-36 are adapted to connect to the contact element 21-23 of a respective phase contact 1-3 in the connected, second position. In the open, first position, the contact surfaces 34-36 are located in a position below their respective phase contacts 1-3 and are thereby electrically insulated from the phase contacts 1-3. Between the contact surfaces 34-36, two insulation areas 33 are disposed on the envelope surface of the movable contact. In the open, first position, the uppermost contact surface 34 is insulated in that the upper, first end 13 of the movable cylinder is located below the first phase contact 1. The two other contact surfaces 35-36 are insulated in that the insulation areas 32 are at the positions of the two phase contacts 2, 3.

It is common to the two embodiments in FIGS. 1 and 2 that the movable contact 4 has an insulating distance 32, 33 between the contact areas 18-20, 34-36 of the movable contact 4.

In order to achieve the movement of the movable contact 4, the device comprises a Thomson coil 17, which is disposed at the bottom portion of the housing 5 and located below the bottom portion 24 of the movable contact 4. When a strong current pulse passes through the Thomson coil 17, the Thomson coil 17 produces a magnetic field in the bottom portion 24 of the movable contact 4. The force from the magnetic field throws the movable contact 4 up to the connected, second position, so that the respective phases of the phase contacts 1-3 are short-circuited and earthed.

Figure 3:
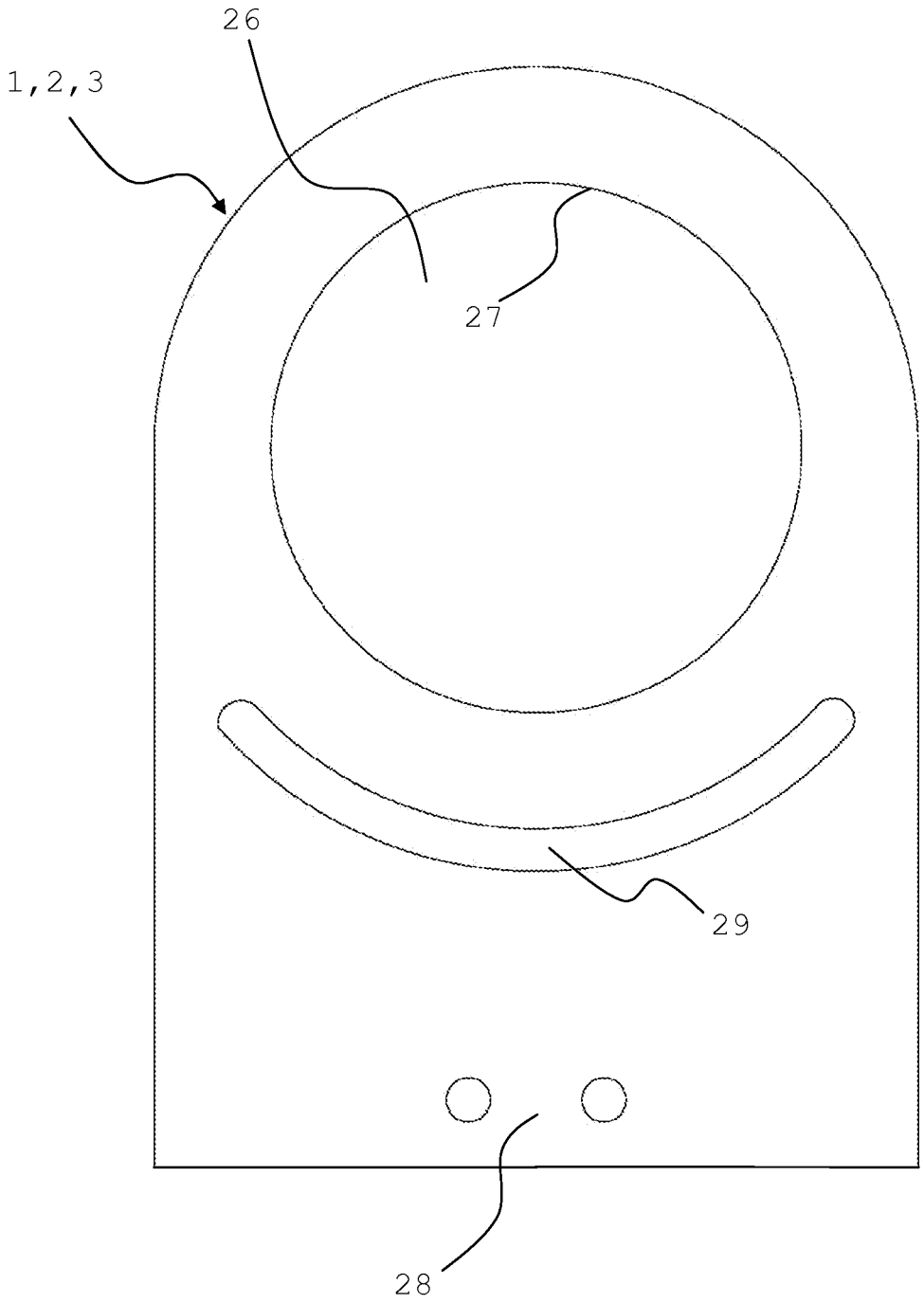
FIG. 3 shows a preferred embodiment of a phase contact.

A preferred embodiment of a phase contact 1-3 is shown in FIG. 3. The phase contact is designed as a connecting terminal to the electric power network. The phase contact exhibits a circularly shaped recess 26 for accommodating the movable contact 4. The envelope surface 27 of the recess 26 is intended to be in electrical contact with the movable contact 4 via the contact elements 18-23. At one end of the phase contact 1-3, a connecting portion 28 is disposed for connection to a phase in the electric power network. In the current path between the connecting portion 28 and the circular recess 26, the phase contact exhibits a U shaped recess 28, which controls the current feeding direction. The surging short-circuiting currents produce large magnetic forces and the U shaped recess 29 prevents these forces from throwing the movable contact 4 sideways. The recess 29 controls and divides the surging current so that any mechanical influence on the movable contact 4 is minimized.

Figure 4:
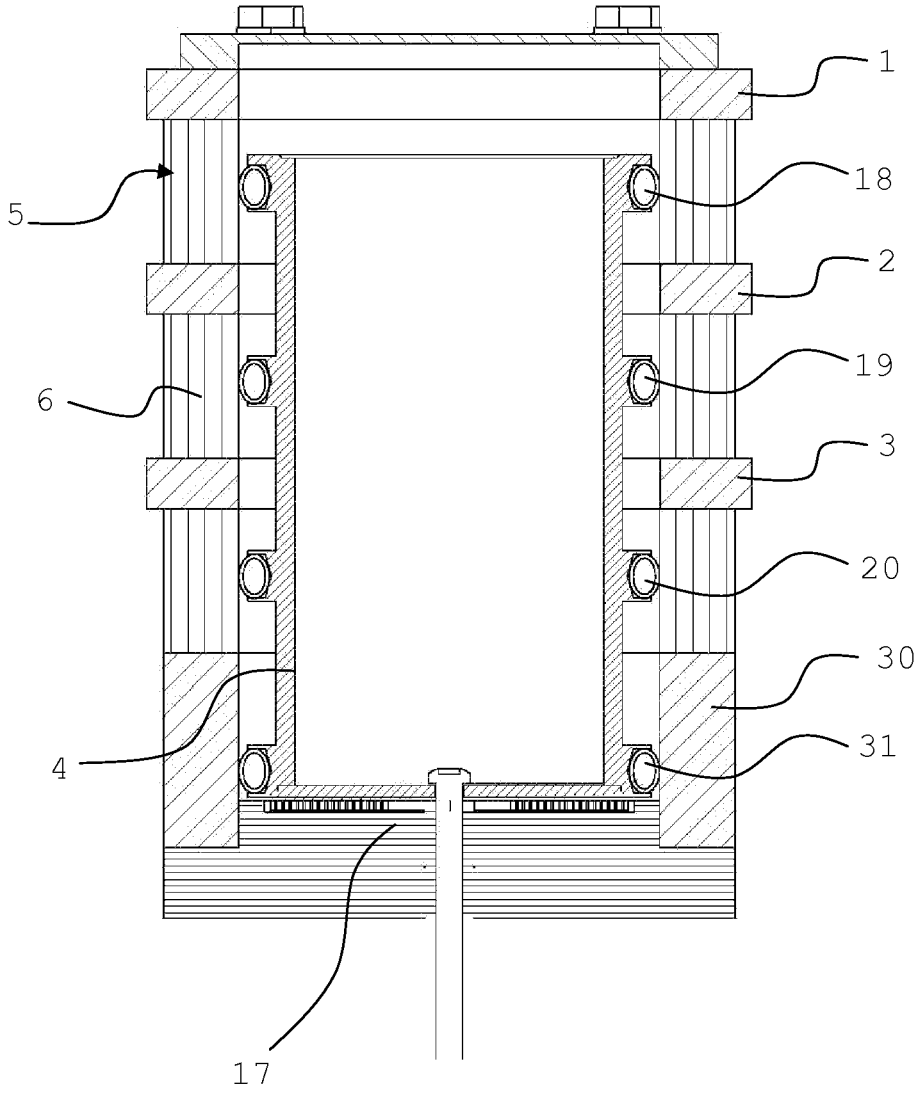
FIG. 4 shows an alternative embodiment for the earthing of the movable contact.
Figure 5:
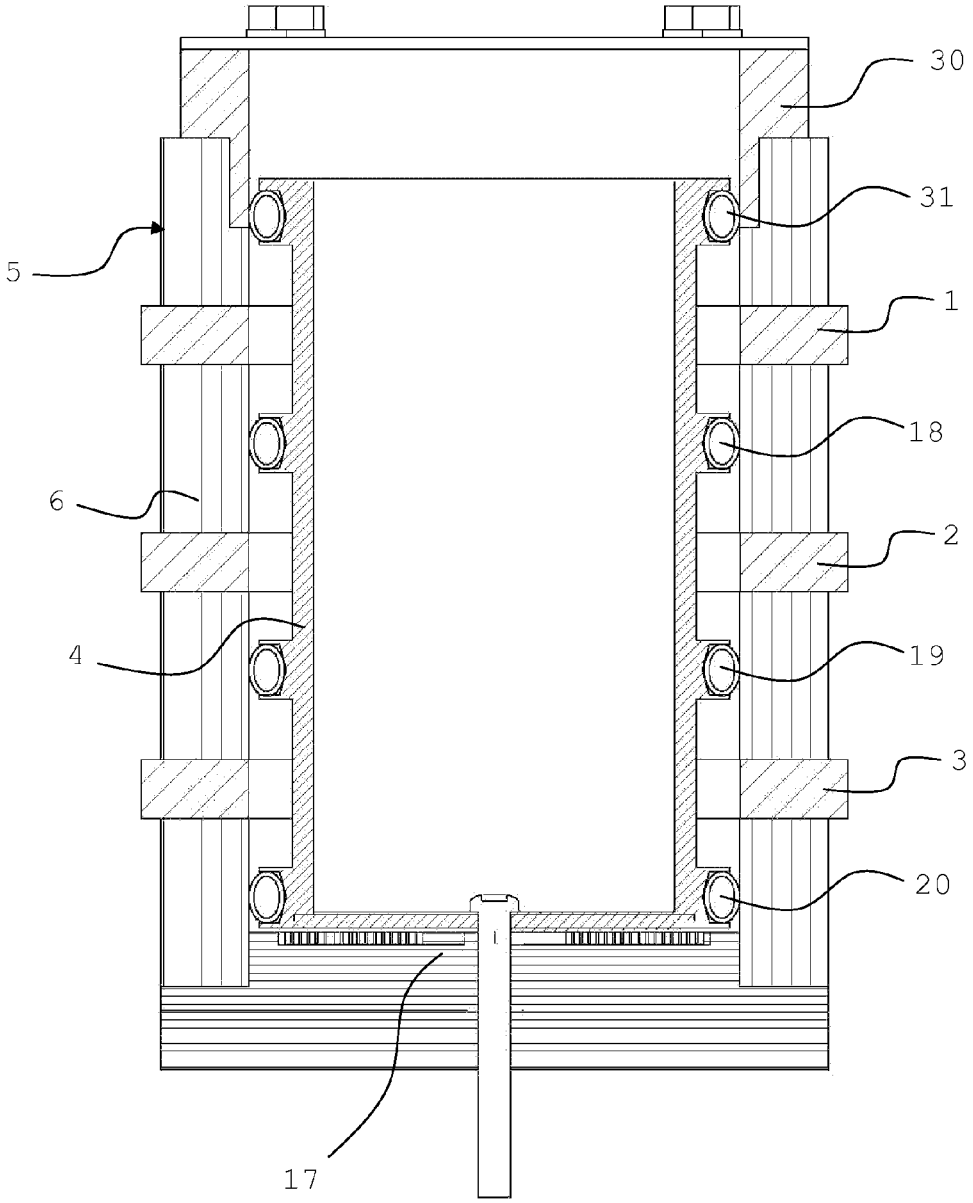
FIG. 5 shows a variant of the embodiment in FIG. 4.

An alternative embodiment, with respect to the earthing of the movable contact 4, is shown in FIGS. 4 and 5. Instead of using the upper, stationary contact 4 according to FIGS. 1 and 2, a stationary, circumferential earthing contact 30, disposed in the walls 6 of the housing 5, is used instead. The earthing contact 30 earths the movable contact 4 on its outside via a circumferential contact element 31, which is disposed circumferentially on the exterior envelope surface of the movable contact 4. In FIG. 4, the earthing contact 31 is disposed in the walls 6 at the bottom portion of the housing 5, and the contact element 31 is disposed close to the lower, second end 14 of the movable contact 4. In FIG. 5, the earthing contact 31 is disposed in the walls 6 at the upper portion of the housing 5, and the contact element 31 is disposed close to the upper, first end 13 of the movable contact.

The above-mentioned contact elements 16, 18-23, 31 are suitably constituted of a continuous, helix-shaped spring with good conductivity. It is appreciated, however, that also other types of contact elements may be adaptable to be disposed on the movable contact 4 and/or the phase contacts 1-3.

During use, the device is normally in an open, first position, which is shown in FIGS. 1 and 2. The contact areas 18-20; 34-36 of the movable contact 4 are thereby located below the contact areas 21-23 of the phase contacts 1-3. In this position, the insulation areas 32, 33 of the movable contact are located at the contact areas 21-23 of the phase contacts. In the event of an arc being detected, a current pulse will trigger the Thomson coil to throw the movable contact 4 to a connected, second position (not shown in any Figure). Thereby, the contact areas 18-20; 34-36 of the movable contact 4 will be at the position of the contact areas 21-23 of the phase contacts 1-3. The phases will thereby be short-circuited and earthed, so that the arc is put out.

Through the unique design of the movable contact 4, it becomes possible to short-circuit all three phases instantaneously, at the same moment. This geometry provides a complete short-circuiting after a short movement, the length of which corresponds to an insulating distance plus contact engagement.

In the foregoing, the invention has been described based on specific embodiments. It is appreciated, however, that also other embodiments and variants are possible within the scope of the following claims. For instance, it is not necessary for the invention to short-circuit all three phases simultaneously. The device is also adaptable to short-circuit only two of the phases, even though short-circuiting of all three phases is preferable. Also the contact elements can be designed in ways alternative to the ones shown in the embodiments with contact springs above. Even though a Thomson coil is preferable for moving the movable contact 4 from the first position to the second position, it will be appreciated that also other types of force-producing devices can be used. Examples of such devices can be other types of coils or powerful spring assemblies.

The invention claimed is:

1. A switching device for short-circuiting and earthing at least two phases in an electric power network, comprising:

a first phase contact, connected to a first phase in the electric power network;

a second phase contact, connected to a second phase in the electric power network; and an earthed, movable contact with a first position, where the movable contact is insulated from the phases and a second position, where the contact is connected to the phase contacts and thereby earths and short-circuits the phases with each other, wherein the first phase contact and the second phase contact are axially displaced from each other and are disposed around the movable contact, and the movable contact is cylinder-shaped and comprises two circumferentially disposed contact areas, which contact areas are axially displaced from each other and intended to be located at an insulating distance from the two phase contacts in the first position, but to connect to the two phase contacts in the second position, so that the phases are short-circuited and earthed via the movable contact in order to achieve a simultaneous short-circuiting of the phases, and that the device comprises electrically insulating areas, which are adapted to abut against the phase contacts in the first position.

2. The device according to claim 1, wherein the device comprises an earthed, stationary contact, which earths the movable contact in the second position.

3. The device according to claim 2, wherein the movable contact is in electrical contact via its interior envelope surface with the stationary contact.

4. The device according to claim 2, wherein the movable contact is in electrical contact via its exterior envelope surface with the stationary contact.

5. The device according to claim 1, wherein the electrically insulating area of the movable contact comprises an air gap.

6. The device according to claim 5, wherein the air gap is formed such that the diameter of the movable contact is larger at the contact areas than the diameter at the insulating area.

7. The device according to claim 1, wherein the device comprises a Thomson coil for transferring kinetic energy to the movable contact, when the movable contact is to move from the first position to the second position.

8. The device according to claim 1, wherein the respective phase contact exhibits a recess in its current path for controlling the current feeding direction.

* * * * *